US008905613B2

(12) United States Patent
Niu et al.

(10) Patent No.: US 8,905,613 B2
(45) Date of Patent: Dec. 9, 2014

(54) DISPLAY DEVICE AND DISPLAY SYSTEM COMBINED THEREOF

(71) Applicant: AU Optronics Corporation, Hsin-Chu (TW)

(72) Inventors: Tzu-Ling Niu, Hsin-Chu (TW); Fu-Cheng Fan, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 51 days.

(21) Appl. No.: 13/927,246

(22) Filed: Jun. 26, 2013

(65) Prior Publication Data

US 2013/0343038 A1 Dec. 26, 2013

(30) Foreign Application Priority Data

Jun. 26, 2012 (TW) ..... 101122808 A
Jun. 21, 2013 (TW) ..... 102122156 A

(51) Int. Cl.

| | |
|---|---|
| ***G09F 13/08*** | (2006.01) |
| ***F21V 5/02*** | (2006.01) |
| ***F21V 11/02*** | (2006.01) |
| ***F21V 13/12*** | (2006.01) |
| ***G09F 13/04*** | (2006.01) |
| ***G09F 9/302*** | (2006.01) |

(52) U.S. Cl.

CPC ..... *G09F 13/04* (2013.01); *G09F 9/3026* (2013.01)

USPC ..... 362/607; 362/290; 362/330; 362/339; 362/602

(58) Field of Classification Search

USPC ..... 362/97.1–97.4, 602, 606, 607, 617, 362/618; 349/57, 61, 62, 65

See application file for complete search history.

(56) References Cited

U.S. PATENT DOCUMENTS 6,166,787 A 12/2000 Akins et al.
6,527,410 B2 * 3/2003 Yamaguchi ..... 362/243

(Continued)

FOREIGN PATENT DOCUMENTS

CN 201007769 1/2008
JP 02-010394 1/1990

(Continued)

OTHER PUBLICATIONS

English translation of abstract of CN 201007769 (published Jan. 16, 2008).

(Continued)

*Primary Examiner* — Alan Cariaso

(74) *Attorney, Agent, or Firm* — McClure, Qualey & Rodack, LLP

(57) ABSTRACT

A display device includes a backlight module, a display panel, a prism film, a light-splitting layer, and a grating layer. The light-splitting layer splits light into a first backlight group and a second backlight group, wherein the two groups are inclined in different directions relative to a light-emitting surface of the backlight module. The grating layer allows the first backlight group to pass while blocking the second backlight group. The prism film has a plurality of prisms disposed facing the display panel. Each prism has a first surface and a second surface, wherein the angle between the first surface and the normal line to the light-emitting surface is greater than the angle between the second surface and the normal line to the light-emitting surface.

18 Claims, 20 Drawing Sheets

(56) References Cited

U.S. PATENT DOCUMENTS

| | | | | |
|---|---|---|---|---|
| 7,400,439 | B2 * | 7/2008 | Holman | 359/298 |
| 8,228,448 | B2 * | 7/2012 | Shiau et al. | 349/15 |
| 8,305,511 | B2 * | 11/2012 | Shiau et al. | 349/51 |
| 8,780,300 | B2 * | 7/2014 | Niioka et al. | 349/66 |
| 2007/0126329 | A1 | 6/2007 | Chuang et al. | |
| 2010/0253591 | A1 | 10/2010 | Hwu et al. | |
| 2012/0307178 | A1 | 12/2012 | Cheng et al. | |

FOREIGN PATENT DOCUMENTS

| | | |
|---|---|---|
| JP | 11-327453 | 11/1999 |
| JP | 2005-243259 | 9/2005 |
| TW | 200720774 | 6/2007 |

OTHER PUBLICATIONS

English translation of abstract of JP 11-327453 (published Nov. 26, 1999).

English translation of abstract of JP 02-010394 (published Jan. 16, 1990).

English translation of abstract of JP 2005243259 (published Sep. 8, 2005).

* cited by examiner

DISPLAY DEVICE AND DISPLAY SYSTEM COMBINED THEREOF

BACKGROUND OF THE INVENTION

1. Field of the Invention

The present invention generally relates to a display device and a display system combined thereof; particularly, the present invention relates to a display device and a display system combined thereof that can negate the effects of panel frame borders on the displaying of images.

2. Description of the Related Art

Display devices, such as electronic products related to liquid crystal display devices, are widely used in everyday life. As the demand for display related devices increases along with increased competition between manufacturers, each display device manufacturer has gradually introduced display products with greater viewing dimensions. As such, the viewing dimension of display devices has become a key factor for a display device's competitiveness in a market of related products. In addition, manufacturers of display devices have also begun to combine multiple display devices together to effectively maintain manufacture of present dimensions of display device while also satisfying the need for display systems of larger display dimensions.

However, combining multiple display devices is no easy task. For instance, each individual display device has borders that would affect the image display effect of the display system once the display devices have been combined together. In order to overcome this predicament, each manufacturer has respectively researched and developed new display technology to decrease the effects of the borders. However, their resulting product tends to decrease the image brightness while increasing the amount of required components for the display device, which subsequently results in an increase in overall thickness of the display device. As shown in FIG. 1 of a conventional display device 50, the display device 50 includes at least two prisms or lens elements, wherein one is a bottom concave lens film 20 and the other is a top convex lens film 40. In the conventional display device, light generated from the backlight module 10 will be dispersed upwards by the bottom indented lens film 20. The dispersed light, after passing through the display panel 30, will expand the range of the image display. As shown in FIG. 1, this expansion may allow the light passing through the display panel 30 to transmit to the top convex lens film 40, wherein the top convex lens film 40 redirects the light upwards so that the display image may be expanded to the prism area 45 above the panel border b of the display panel 50. In this manner, the effects of the panel frame border on the displayed image may be narrowed. However, the above mentioned conventional display device would need to use two lens films, adding to the overall thickness of the display device while also decreasing the image brightness. In addition, in terms of usage, since there are size limitations in the manufacturing of lens films, the above design would primarily only be utilized on devices with small dimensions, such as handheld display devices. That is, it would not be applicable to laptop computers or televisions sets.

SUMMARY OF THE INVENTION

It is an object of the present invention to provide a display device that can decrease the effects of the device's border frame on the image display.

It is another object of the present invention to provide a display device that will not decrease image brightness when the displayed image shifts or expands.

It is another object of the present invention to provide a display device that can shift or expand images without increasing the thickness of the display device.

It is yet another object of the present invention to provide a display system combined from the above display devices that can decrease the effect of the combined border frames on the image display.

The display device includes a backlight module, an optical film set, a display panel, and a prism film. The backlight module has a light-emitting surface and generates backlight along a normal direction of the light-emitting surface. The optical film set includes a light-splitting layer and a grating layer. The light-splitting layer is disposed above the light-emitting surface, wherein the light-splitting layer splits the backlight into a first backlight group and a second backlight group, and average light-emitting directions of both backlight groups are inclined with respect to the light-emitting surface with vector components thereof in a direction parallel to the light-emitting surface having opposite directions. The grating layer is disposed above the light-splitting layer, wherein the grating layer only allows the first backlight group to pass while blocking the second backlight group from passing. The display panel is disposed above the grating layer. The prism film is disposed on one side of the display panel opposite to the optical film set, wherein the prism film has a plurality of prisms disposed side-by-side on one side of the prism film facing the display panel. An extending direction of the prisms at least partially traverse across the average light-emitting direction of the first backlight group, wherein two sides of each prism are respectively a first surface and a second surface. The first surface and the second surface are asymmetric and projection areas of the first surface and the second surface onto the prism film do not overlap. An angle between the first surface and a normal line to the light-emitting surface is greater than an angle between the second surface and the normal line to the light-emitting surface, and a bottom angle of the second surface is greater than or equal to 80 degrees and smaller than or equal to 90 degrees.

A display system includes two of the above display devices, wherein the two display devices are disposed side-by-side and the vector component on the light-emitting surface of the average light-emitting direction of the first backlight group of each display device is towards the other display device.

A display system includes four of the above display devices, wherein the display devices are disposed in a 2×2 matrix to form a combined display surface, and the direction of the vector component on the light-emitting surface of the average light-emitting direction of the first backlight group of each display device is towards the other display device that is disposed diagonal of the display device.

DETAILED DESCRIPTION OF THE PREFERRED EMBODIMENT

The present invention provides a display device and display system combined thereof. The display device preferably includes a liquid crystal display device and has a side view backlight module. However, in other different embodiments, the display device may use top view backlight modules.

Figure 1:
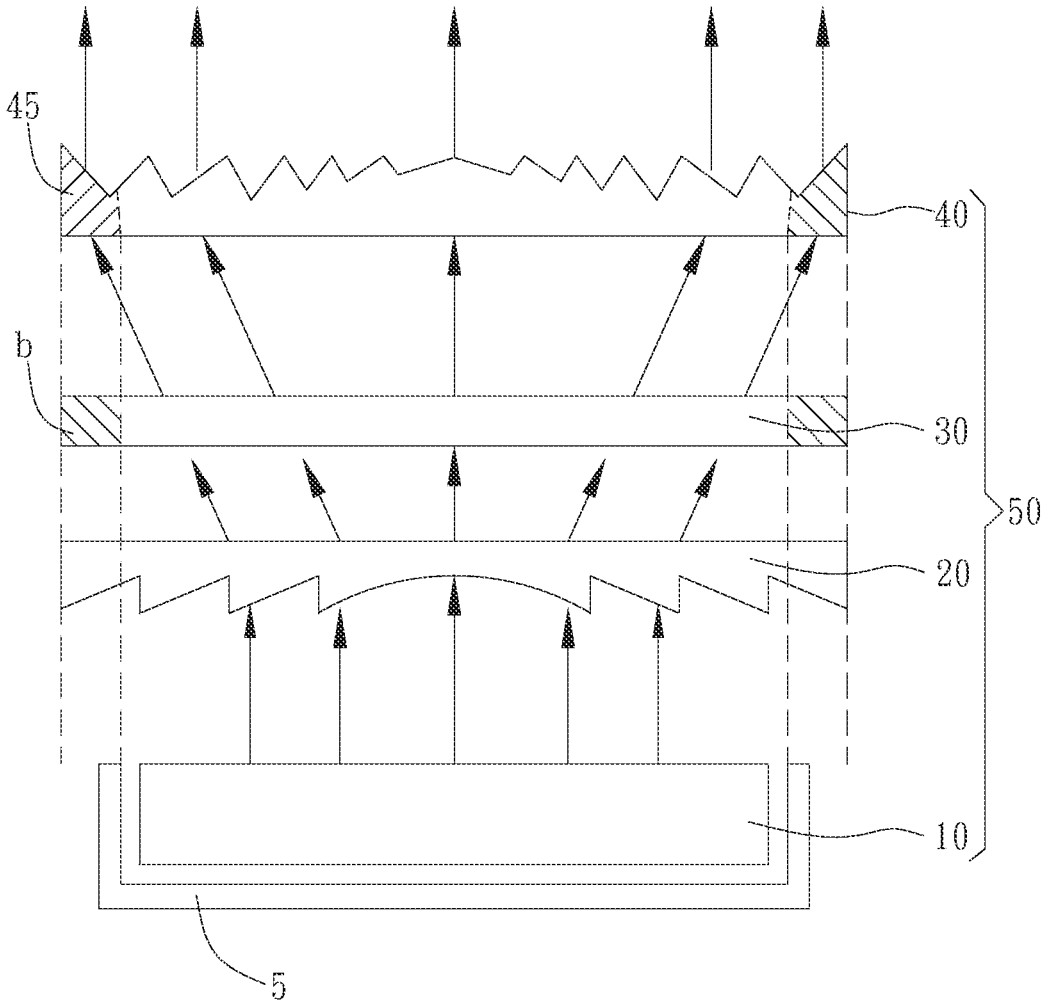
FIG. 1 (PRIOR ART)
FIG. 1 is a schematic view of the conventional display device.
Figure 2A:
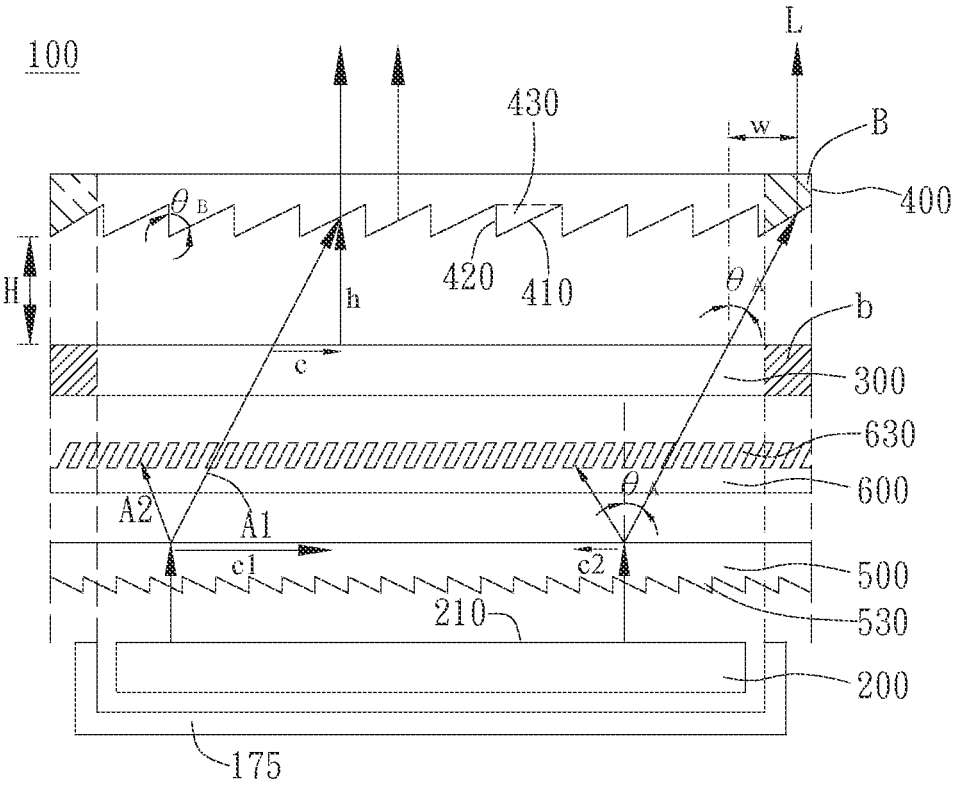
FIG. 2A is a cross-sectional view of an embodiment of the display device of the present invention.

Please refer to FIG. 2A of an embodiment of a display device 100 of the present invention. The display device 100 includes a backlight module 200, a display panel 300, a prism film 400, a light-splitting layer 500, and a grating layer 600. The backlight module 200 has a light-emitting surface 210, wherein the light-emitting surface 210 is preferably the top surface of the backlight module 200. In the present embodiment, the display panel 300 is disposed above the light-emitting surface 210, while the prism film 400 is disposed on one side of the display panel 300 opposite to the backlight module 200. In other words, the prism film 400 is disposed above the display panel 300 such that the display panel 300 is sandwiched between the prism film 400 and the backlight module 200. In the present embodiment, the prism film 400 includes a plurality of prisms 430 disposed side-by-side on a surface of the prism film 400 facing the display panel 300.

Figure 2B:
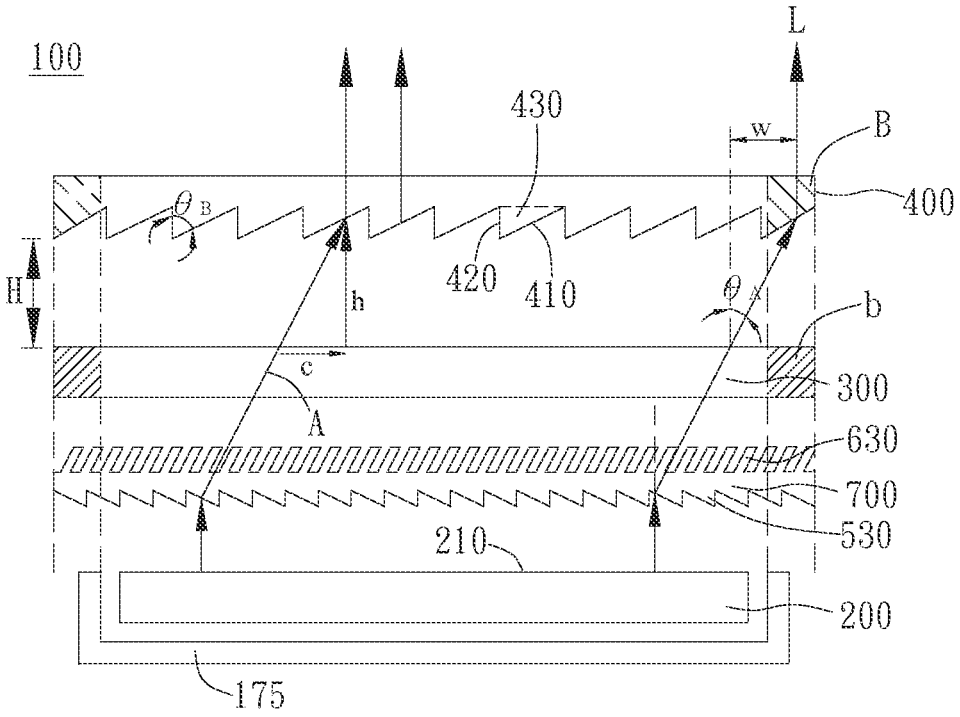
FIG. 2B is another embodiment of FIG. 2A.

As shown in FIG. 2A, the light-splitting layer 500 is preferably disposed above the backlight module 200, but below the display panel 300. On the other hand, the grating layer 600 is disposed between the light-splitting layer 500 and the display panel 300. In the present embodiment, the light-splitting layer 500 and the grating layer 600 are formed respectively on independent optical films. However, in other different embodiments, the light-splitting layer 500 and the grating layer 600 may be formed on opposite surfaces of a single optical film 700, as shown in FIG. 2B.

As shown in FIG. 2A, the backlight generated by the backlight module 200 is preferably emitted along the normal direction of the light-emitting surface 210 towards the light-splitting layer 500. The light-splitting layer 500 will split the backlight into a first backlight group A1 and a second backlight group A2, wherein the average light-emitting directions of both the first backlight group A1 and the second backlight group A2 are inclined with respect to the light-emitting surface 210. The vector components of the two groups, in a direction parallel to the light-emitting surface 210, have opposite directions. In other words, as shown in FIG. 2A, the vector direction $c_1$ of the first backlight group A1 is opposite in direction to the vector direction $c_2$ of the second backlight group A2. The average light-emitting direction preferably refers to the direction represented by the weighted average of the light intensities of each light ray in either the first backlight group A1 or the second backlight group A2. In practice, although the present invention accomplishes image shift or image expansion through the prism film 400, the light-splitting layer 500, and the grating layer 600, in comparison to the prior art, decrease in brightness in the present invention is noticeably less.

Figure 3A:
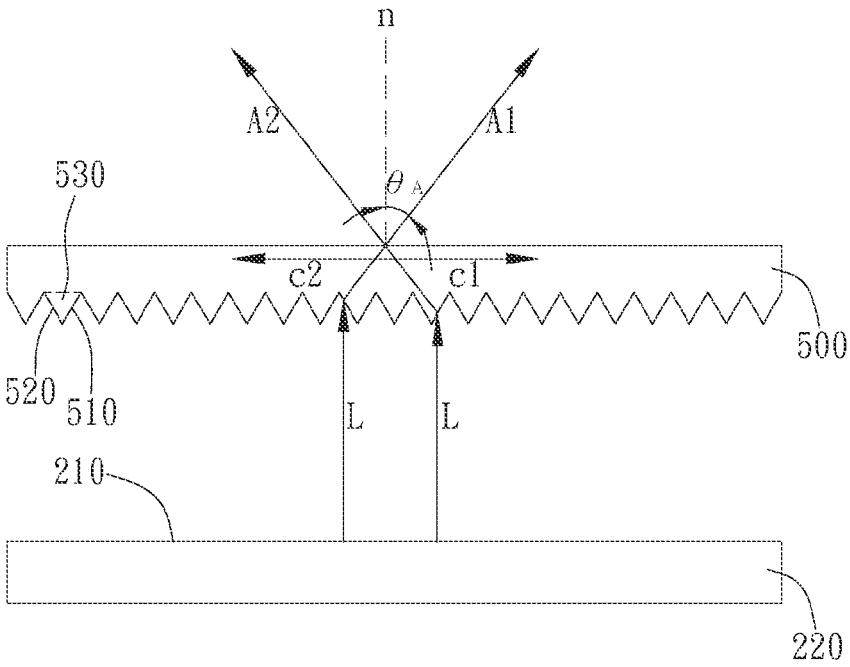
FIG. 3A is a cross-sectional view of an embodiment of the prism film.
Figure 3B:
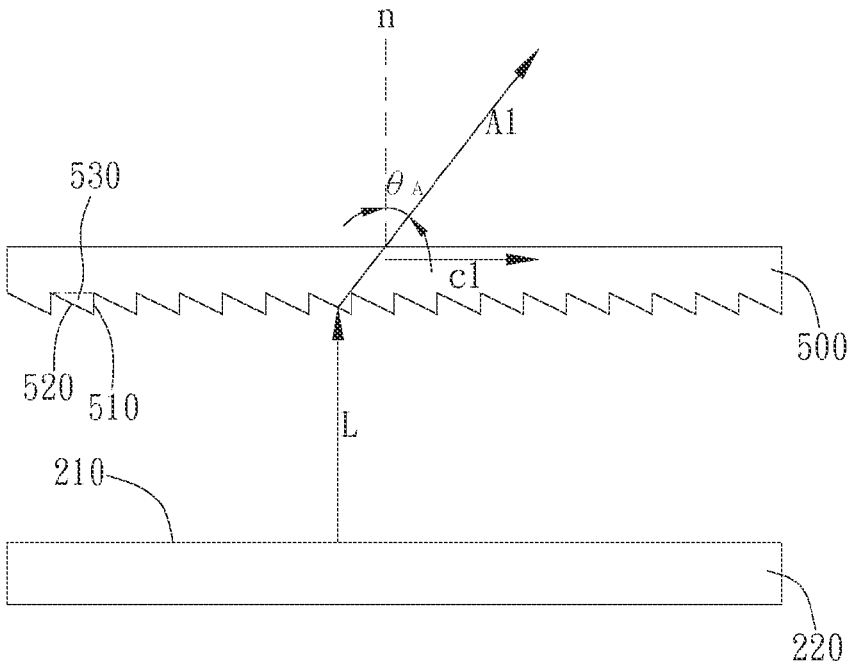
FIG. 3B is another embodiment of FIG. 3A.

FIG. 3A is an embodiment of the light-splitting layer 500 of FIG. 2A. As shown in FIG. 3A, the light-splitting layer 500 includes a plurality of light-splitting prisms 530. Light-splitting prism 530 has a first light-splitting surface 510 and a second light-splitting surface 520. When backlight L is emitted to the light-splitting layer 500 from the backlight module 200, the light-splitting prism 530 of the light-splitting layer 500 will split the backlight L into the first backlight group A1 and the second backlight group A2. In the present embodiment, the first light-splitting surface 510 is symmetrical with respect to the second light-splitting surface 520, wherein they respectively refract the backlight L from the light-emitting surface 210 of the backlight module 200 towards the direction of the second backlight group A2 and the first backlight group A1. In the present embodiment, the amount of light of the first backlight group A1 is identical to the amount of light of the second backlight group A2. However, since the second backlight group A2 will be blocked by the overlying grating layer 600 and result in the image brightness of the display device 100 to decrease by half in this case, the angle between the first light-splitting surface 510 and the second light-splitting surface 520 may be changed such that the ratio of distribution of light amounts between the first backlight group A1 and the second backlight group A2 may be adjusted. As shown in FIG. 3B of another embodiment, the first light-splitting surface 510 of the light-splitting prism 530 may be perpendicular or nearly perpendicular to the light-emitting surface 210. When the first light-splitting surface 510 is perpendicular or near perpendicular to the light-emitting surface 210, the backlight L from the backlight module 200 will be emitted to the second light-splitting surface 520 of each light-splitting prism 530 of the light-splitting layer 500. Since the majority of the backlight L will come in contact with the second light-splitting surface 520, the majority of the light will be refracted towards the direction of the average light-emitting direction of the first backlight group A1 such that the display device 100 may maintain good image display brightness.

Also as shown in FIG. 2A, after the backlight L has been split into the first backlight group A1 and the second backlight group A2 by the light-splitting layer 500, the light will emit towards the grating layer 600 in the direction of the first and second backlight groups. When the first backlight group A1 and the second light group A2 reach the grating layer 600 from the light-splitting layer 500, the grating layer 600 will allow the first backlight group A1 to pass while blocking the second backlight group A2 from passing.

Figure 4A:
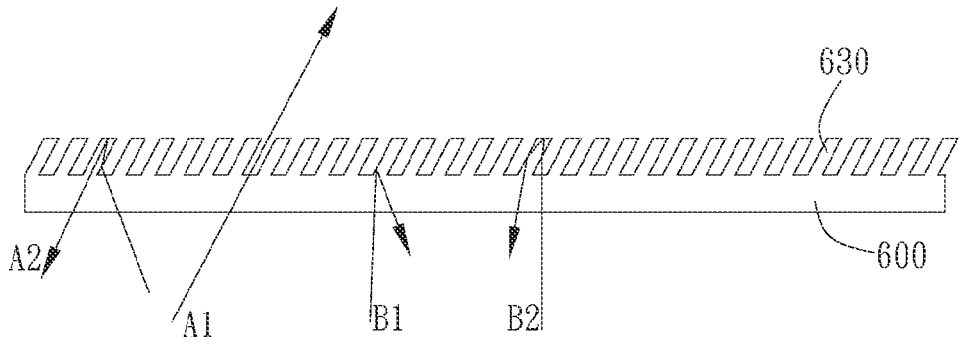
FIGS. 4A-4C are embodiments of the grating layer.

FIG. 4A is an embodiment of the grating layer 600. As shown in FIGS. 2A and 4A, the grating layer 600 has a plurality of light-blocking structures 630, wherein these light-blocking structures 630 are distributed in side-by-side arrangement on the surface of the grating layer 600, inclined to the average light-emitting direction of the first backlight group A1 on the surface of the grating layer 600. Since the inclination direction of each light-blocking structure 630 of the grating layer 600 is parallel with the average light-emitting direction of the first backlight group A1, when the first backlight group A1 is emitted to the grating layer 600 from the light-splitting layer 500, the light-blocking structure 630 will not block the first backlight group A1. In other words, the light-blocking structure 630 will allow the first backlight group A1 to pass through. However, if the backlight from the light-splitting layer 500 is not emitted to the grating layer 600 in the average light-emitting direction of the first backlight group A1 (for instance: the second backlight group A2, backlight B1, and backlight B2), the backlight will be reflected back to the light-splitting layer 500 by the light-blocking structure 630 of the grating layer 600. In other words, the light blocking structure 630 will block any light not parallel to the average light-emitting direction of the first backlight group A1 (blocking light such as the second backlight group A2).

Figure 4B:
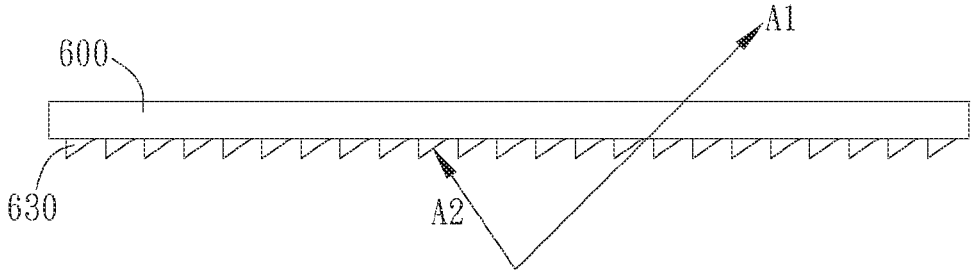

FIG. 4B is another embodiment of the grating layer 600 of FIG. 4A. As shown in FIG. 4B, the light-blocking structure 630 of the grating layer 600 may be a type of structure with light absorbing capabilities. In the present embodiment, the light-blocking structure 630 is disposed on a surface of the grating layer 600 facing the backlight module 200, wherein the shape thereof is preferably smaller than the prism 430 of the prism film 400. As shown in FIG. 4B, when the backlight of non first backlight group A1 (such as the backlight of the second backlight group A2) is emitted to the grating layer 600, the backlight of the non first backlight group A1 will be absorbed by the light-blocking structure 630 (i.e. blocked). Light having the direction of the first backlight group A1 will be emitted into the grating layer 600 between the light-blocking structures 630 and out of the light-emitting surface of the grating layer 600, maintaining the direction of the first backlight group A1. In the present embodiment, since the backlight from below reaches the grating layer 600 along the direction of the first backlight group A1 or the second backlight group A2 and the light-blocking structures 630 of the grating layer 600 is smaller respectively to the prisms 430, the light-blocking structures 630 can effectively absorb backlight of non first backlight group A1 while also decrease the absorption of backlight of the first backlight group A1.

Figure 4C:
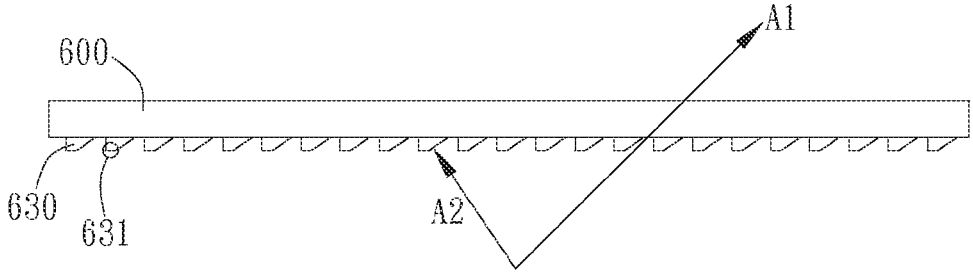

FIG. 4C is another embodiment of FIG. 4B. As shown in FIG. 4C, the light-blocking structure 630 has a taper angle (draft angle) 631. In the present embodiment, the taper angle 631 is provided for the grating layer 600 such that during manufacturing the grating layer 600 may be easily separated from the mold.

When the first backlight group A1 passes through the grating layer 600 and arrives at the display panel 300, the plurality of pixels of the display panel 300 may selectively allow or block the backlight emitted from the grating layer 600 to pass through. The first backlight group A1 that passes through will be refracted straight up parallel to the direction L by the overlying prism film 400.

In actuality, the relationship between the above mentioned display panel 300, prism film 400, light-splitting layer 500, and grating layer 600 may be expressed in the following equation:

$$w=H\times\tan(\theta_A)$$

Figure 5:
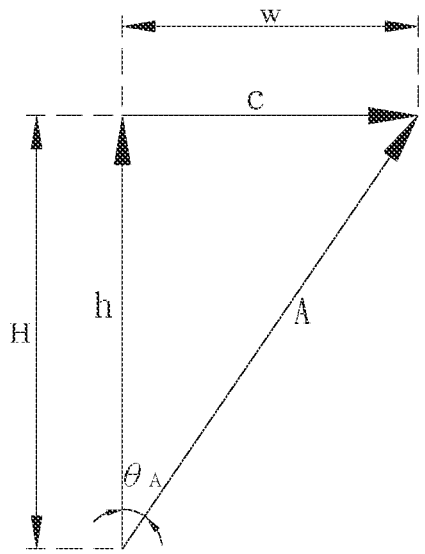
FIG. 5 is a relational diagram of the elements in FIG. 2A.

As shown in FIGS. 2A, 2B, and 5, the image shift distance w refers to the distance of image shift of the image generated by the display device 100. Height H refers to the distance between the prism film 400 and the display panel 300. Angle $\theta_A$ is the angle between the first backlight group A1 (average light-emitting direction) and the normal line to the light-emitting surface 210 (this angle is also the angle between light emitted out from the display panel 300 and the normal line to the light-emitting surface 210). The h is the vector component of the first backlight group A1 parallel to the normal line of the light-emitting surface 210. As shown in FIG. 2B as well as the equation above, any one of the image shift distance w, height H, and angle $\theta_A$ may be adjusted according to design requirements. In more definite terms, backlight emitted in the direction of the normal to the light-emitting surface 210 will be split into the first backlight group A1 and the second backlight group A2 after passing through the light-splitting layer 500. The two groups of light will respectively head in a direction of the first backlight group A1 (average light-emitting direction) and the second backlight group A2 (another average light-emitting direction) out of the light-splitting layer 500. The second backlight group A2 will be blocked by the grating layer 600, while the first backlight group A1 will pass through the display panel 300 to be emitted to the prism film 400. Since the average light-emitting direction of the first backlight group A1 has an angle $\theta_A$ with the normal line to the light-emitting surface 210—and not in the direction of the normal line to the light-emitting surface 210 of the conventional backlight module—the image displayed above the prism film 400 will be shifted towards the outer edges with respect to the original conventional position. The image shift distance w is preferably equal to or greater than the width of the prism area B of the display device 100. In the present embodiment, the prism area B is the area of prism film that lies above the panel border b of the display panel 300 (in other words, the width of prism area B will be identical to the width of the panel border b). When the image shift distance w is equal to or greater than the width of the prism area B of the display device 100, light from the backlight module 200 (first backlight group A1) passing through the display panel 300 will be able to be refracted vertically upwards by the prism area B of the prism film 400 above the panel border b of the display panel 300. Through this design, the first backlight group A1 that has passed through the display panel 300 may be emitted to the prism area B of the prism film 400 and accomplish the effect of borderless image display. In the present embodiment, the grating layer 600 blocks backlight of non first backlight group A1 (such as second backlight group A2), while allowing first backlight group A1 to pass. However, in other different embodiments, the grating layer 600 may conversely block the first backlight group A1 and allow the second backlight group A2 to pass.

Figure 6A:
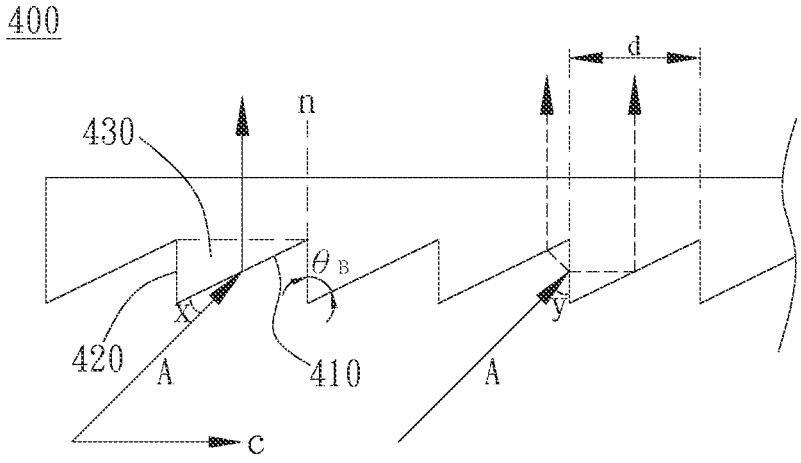
FIG. 6A is a cross-sectional view of an embodiment of the prism film.

FIG. 6A is an embodiment of the prism film 400. As shown in FIG. 6A, the prism film 400 has a plurality of prisms 430. In the present embodiment, the plurality of prisms 430 is distributed on the entirety of the bottom surface of the prism film 400. However, in other different embodiments, the plurality of prisms 430 may only be distributed on the bottom surface of the prism film 400 along the edge boundaries. Correspondingly, the mentioned light-splitting layer 500 and the grating layer 600 will also accordingly to the prisms 430 have corresponding distribution positions below, wherein conventional optical films such as diffuser films or brightness enhancement films may be disposed in the areas where the light-splitting layer 500 and the grating film 600 are not disposed. The two sides of each prism 430 are respectively the first surface 410 and the second surface 420. The first surface 410 and the second surface 420 are not symmetrical, and their projections onto the prism film 400 do not overlap. In other words, the first surface 410 and the second surface 420 either facing away from the prism film 400 or perpendicular to the prism film 400, wherein no one surface will be facing the prism film 400 to form an inner recessed space. In order to decrease crosstalk interference from being generated in the image by the display device 100, the majority of light emitted from the display panel 300 will be refracted up by the first surface 410 of the prisms 430. When light arrives at the first surface 410, the first surface 410 can refract the light from the display panel 300 vertically upwards in a single refraction manner. The second surface 420 will reflect or refract light towards the inner surface of the first surface 410 such that the first surface 410 will reflect or refract the light from the second surface 420 upwards. Therefore, in order to control the light to be reflected or refracted vertically upwards and decrease crosstalk interference, the first surface 410 is preferably not symmetrical to the second surface 420.

As shown in FIG. 6A, the first surface 410 is back facing the vector component c of the average light-emitting direction A on the light-emitting surface 210, while the second surface 420 faces the vector component c of the average light-emitting direction A on the light-emitting surface 210. In other words, the second surface 420 is a surface that positively meets the average light-emitting direction A, while the first surface 410 is the surface that does not positively meet the average light-emitting direction A. Although the first surface 410 comparatively is the side that does not more positively meet the average light-emitting direction A, the size of the angle between the first surface 410 and the normal line to the light-emitting surface 210 is still enough to receive backlight of average light-emitting direction A, as shown in FIG. 6A, and then to refract the light parallel to the normal line of the light-emitting surface 210. In other words, the first surface 410 refracts the backlight from the display panel 300 vertically upwards. In the present embodiment, a prism contact angle x between the first surface 410 and the average light-emitting direction A is smaller than a prism contact angle y between the second surface 420 and the average light-emitting direction A.

In addition, in the present embodiment as shown in FIGS. 2A and 6A, the second surface 420 is preferably perpendicular to the light-emitting surface 210 to ensure the image clarity of the display device 100 as well as to prevent the problem of generating crosstalk interference. Each prism has a prism width d, wherein prism width d is preferably smaller than 50 μm. However, in other different embodiments, the prism width d may be set as 100 μm according to design requirements. In the present embodiment, the first surface 410 and the second surface 420 of the prism 430 will not block light from passing through. However, in other different embodiments, the second surface may form a light-blocking layer to block light from passing through. The purpose of this is to decrease the effects of the mentioned crosstalk interference.

Figure 6B:
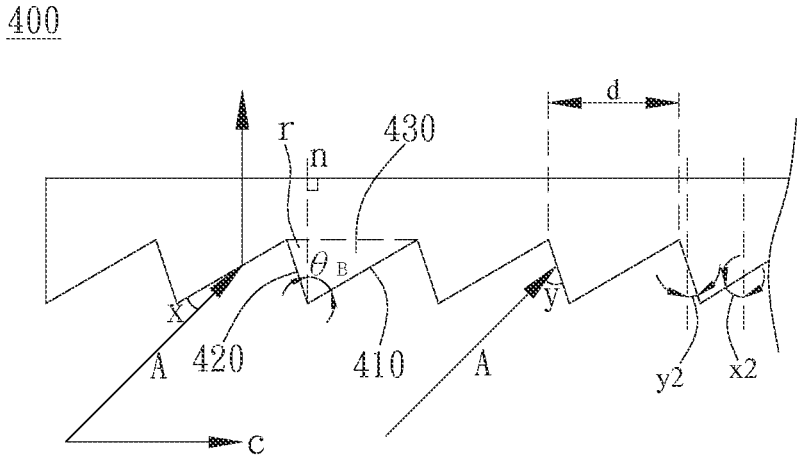
FIG. 6B is another embodiment of the FIG. 6A.

FIG. 6B is another embodiment of FIG. 6A. As shown in FIG. 6B, the angle $\theta_B$ between the first surface 410 of each prism 430 of the prism film 400 and the normal line to the light-emitting surface 210 is preferably greater than 40 degrees, while the angle r between the second surface 420 and the normal line n to the light-emitting surface 210 may be smaller than 10 degrees. The purpose of disposing the angle r is that when roll-to-roll manufacturing process or injection process is utilized to manufacture the prism film 400, the prism film 400 can be more easily separated from the mold if the mold has a taper angle (draft angle) such that the prism microstructure may be more perfectly transcribed. In this case, angle r is correspondingly generated from the taper angle of the mold. However, if the taper angle is overly large, more backlight from the display panel 300 (first backlight group A1) will be emitted to the second surface 420 and increase crosstalk interference, consequently affecting the quality and clarity of the image produced by the display device 100. Therefore, under the basis of functionality and manufacturing, angle r is preferably smaller than 10 degrees such that crosstalk interference may be suppressed. Through this design, the projections of the first surface 410 and the second surface 420 onto the prism film 400 will still not overlap with the first surface 410 and/or second surface 420 of neighboring prisms. However, in other different embodiments, angle r may be greater than 10 degrees and smaller than 40 degrees, such that slight crosstalk interference may be produced to accomplish the effect of three dimensional image display.

As shown in FIG. 6B, an angle x2 between the first surface 410 and the normal line to the light-emitting surface (in other words, angle $\theta_B$) is greater than an angle y2 between the second surface 420 and the normal line to the light-emitting surface. In other words, in comparison to the first surface 410, the second surface 420 is more inclined to the light-emitting surface of the prism film 400. In the present embodiment, the first surface 410 and the second surface 420 of the prism 430 each have a bottom angle. The bottom angle of the second surface 420 is preferably larger than or equal to 80 degrees and smaller than 90 degrees. However, in other different embodiments, these bottom angles may be adjusted according to design requirements. In practice, the bottom angles of the first surface 410 and the second surface 420 are adjusted according to the angles at which the first backlight group A1 arrives at the first surface 410 and the second surface 420, so that the first surface 410 may refract the first backlight group A1 upwards. The bottom angle of the second surface 420 is adjusted such that not too much crosstalk interference will be generated, while still also allowing the second surface 420 to have an inclination.

Figure 7A:
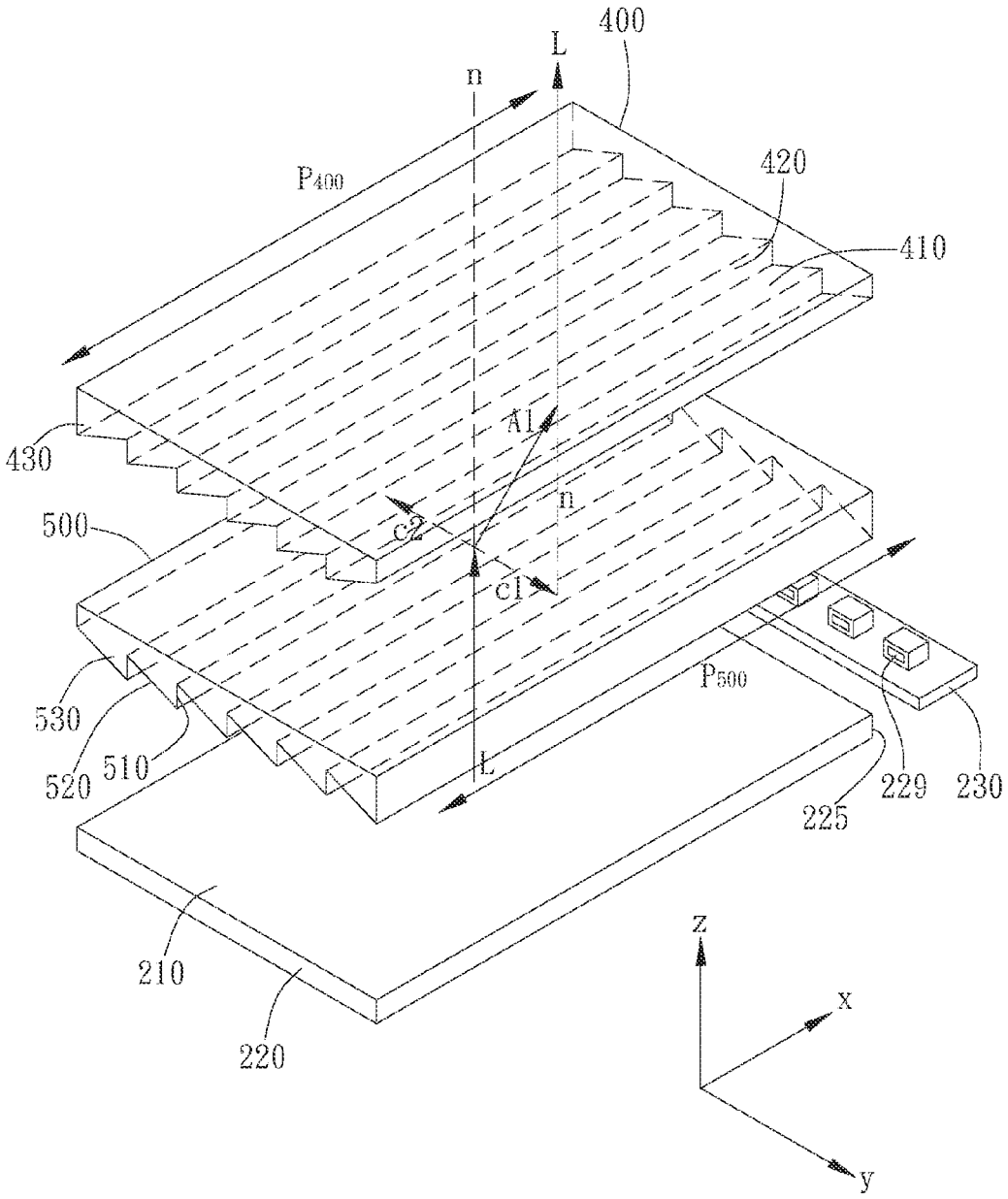
FIG. 7A is an exploded view of an embodiment of the display device.

FIG. 7A is an exploded view of an embodiment of the display device 100. It should be noted that for the convenience showing the relationship between the backlight module 200, prism film 400, and light-splitting layer 500, FIG. 7A has disregarded showing the display panel 300 and grating layer 600 that should be disposed between the light-splitting layer 500 and the prism film 400 so that FIG. 7A may be more comprehensible. As shown in FIGS. 3B and 7A, in the present embodiment, a light source module 230 is preferably a type of Light-Emitting Diode (LED) light source module having at least a light-emitting surface 229. Light generated by the light source module 230 is emitted from the light source surface 229 into a light-entrance side 225 of a light guide plate 220. The light guide plate 220 then guides the light out through the light-emitting surface 210 in the direction parallel to the normal line to the light-emitting surface 210 (such as the direction of backlight L of FIG. 7A). As shown in FIG. 7A, the backlight L is emitted out of the light-emitting surface 210 parallel in direction to the normal line of the light-emitting surface 210 and is then guided by the second light-splitting surface 520 of the light-splitting prism 530 of the light-splitting layer 500 towards the average light-emitting direction of the first backlight group A1. As previously explained, the second backlight group A2 having vector component c2 will be blocked by the grating layer 600. When light of the first backlight group A1 reaches the prism film 400, the first backlight group A1 will once again be guided by the first surface 410 of the prism 430 towards the direction parallel with the normal line to the light-emitting surface 210 (in other words, in the direction vertically upwards with respect to the light-emitting surface 210).

As shown in FIG. 7A, the (prism) extending direction $P_{400}$ of each prism 430 is preferably parallel with the extending direction $P_{500}$ of each light-splitting prism 530. In the present embodiment, the extending direction $P_{500}$ is preferably perpendicular to the light-entrance side 225 of the light guide plate 220 of the backlight module 200, wherein the light-entrance side 225 is a surface of the light guide plate 220 opposite to or in contact with the LED light source module 230. In more definite terms, in the present embodiment, the z-axis is parallel with the normal line n to the light-emitting surface 210, and the plane formed between the z-axis with the extending direction $P_{400}$ is parallel to the plane formed between the z-axis with the extending direction $P_{500}$ (that is, they are coplanar), wherein both planes are perpendicular to the surface of the light-entrance side 225. In other words, in terms of the projection onto the light-emitting surface 210, the average direction of the first backlight group A1 will overlap with the vector component c1, while simultaneously be perpendicular to the prism extending direction $P_{400}$ and extending direction $P_{500}$. In short, the extending direction $P_{400}$ traverses across the average light-emitting direction of the first backlight group A1. In the present embodiment, since the light-splitting prisms 530 are distributed in straight lines and are perpendicular to the distribution direction of the light source module 230, light having average light-emitting direction of the first backlight group A1 at any point on the light-splitting layer 500 will traverse the prism extending direction $P_{400}$ (i.e. perpendicular to the extending direction $P_{400}$). The advantage of this design is that the prism film 400 can evenly distribute the light generated by the light source module 230 vertically upwards to the above image display area, decreasing the circumstances of uneven brightness from occurring. However, in other different embodiments, the extending direction $P_{500}$ may be parallel to the light-entrance side 225 of the light guide plate 220 of the backlight module 200.

Figure 7B:
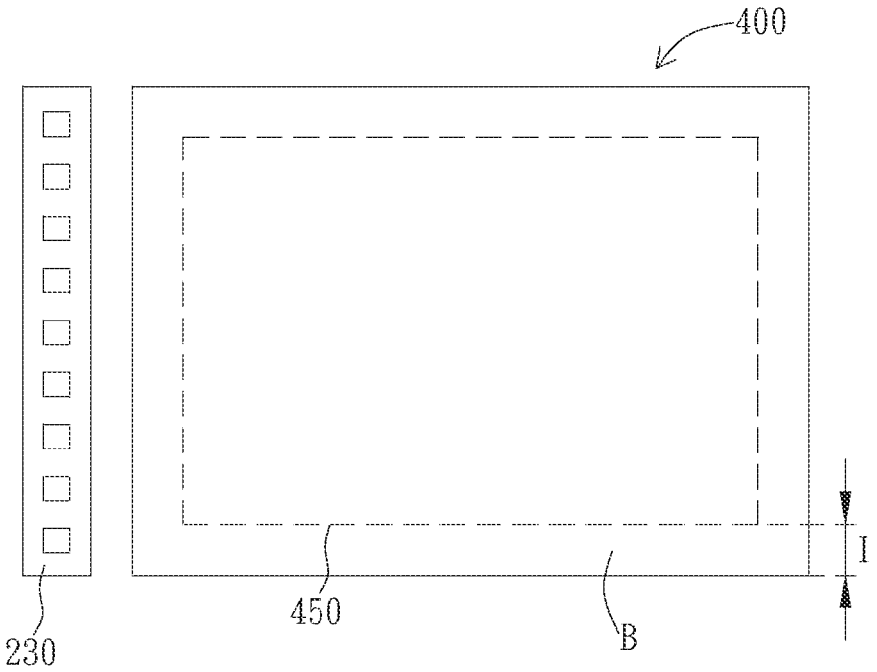
FIGS. 7B and 7C are top views of FIG. 7A.
Figure 7C:
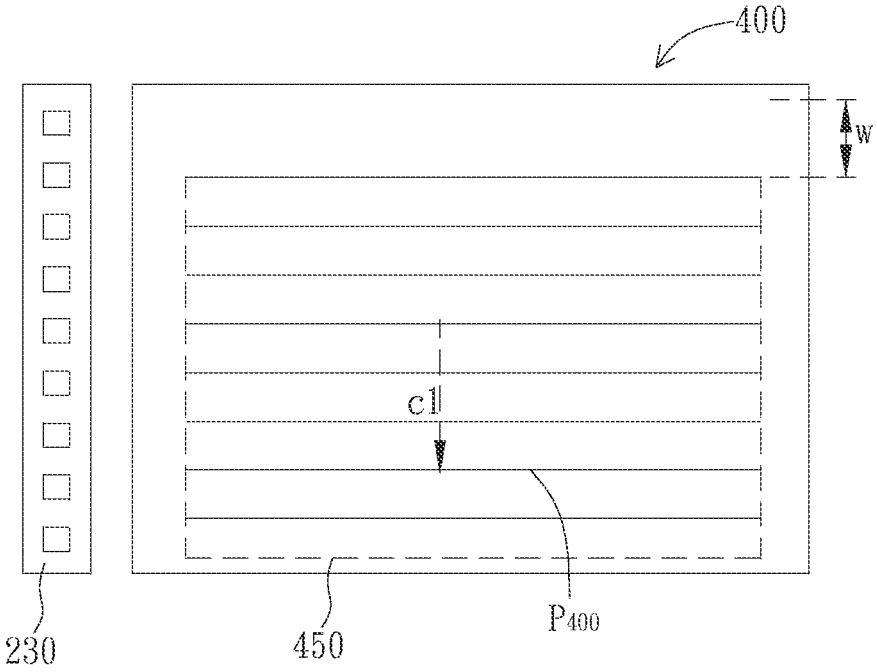

FIG. 7B illustrates the border area on the display surface of the display device 100. As shown in FIG. 7B, there is a border area of prism area B with a width I on the outer edges of the display device 100. In short summary, through the coordination between the light-splitting layer 500, the grating layer 600, and the prism film 400, the image display area 450 will shift towards the right side of the light source module 230 when facing the prism film 400 (i.e. direction of vector component c1). The image display area 450 will move in the direction of the vector component c1 a distance of image shift distance w. This will result in a decrease in the border width I on the side of the display surface that is right of the direction the light source module 230 is facing the prism film 400, as shown in FIGS. 7B and 7C. As shown in FIG. 7C, the extending direction $P_{400}$ of the plurality of prisms 430 of the prism film 400 can be clearly seen to be perpendicular to the light-entrance side 225 facing the light source module 230. At the same time, the projection of the extending direction $P_{400}$ onto the prism film 400 is also perpendicular to the vector component c1. As mentioned, in the present embodiment the extending direction $P_{400}$ of the plurality of prisms 430 of the prism film 400 is preferably parallel with respect to the extending direction $P_{500}$ of the plurality of light-splitting prisms 530 of the light-splitting layer 500.

Figure 8A:
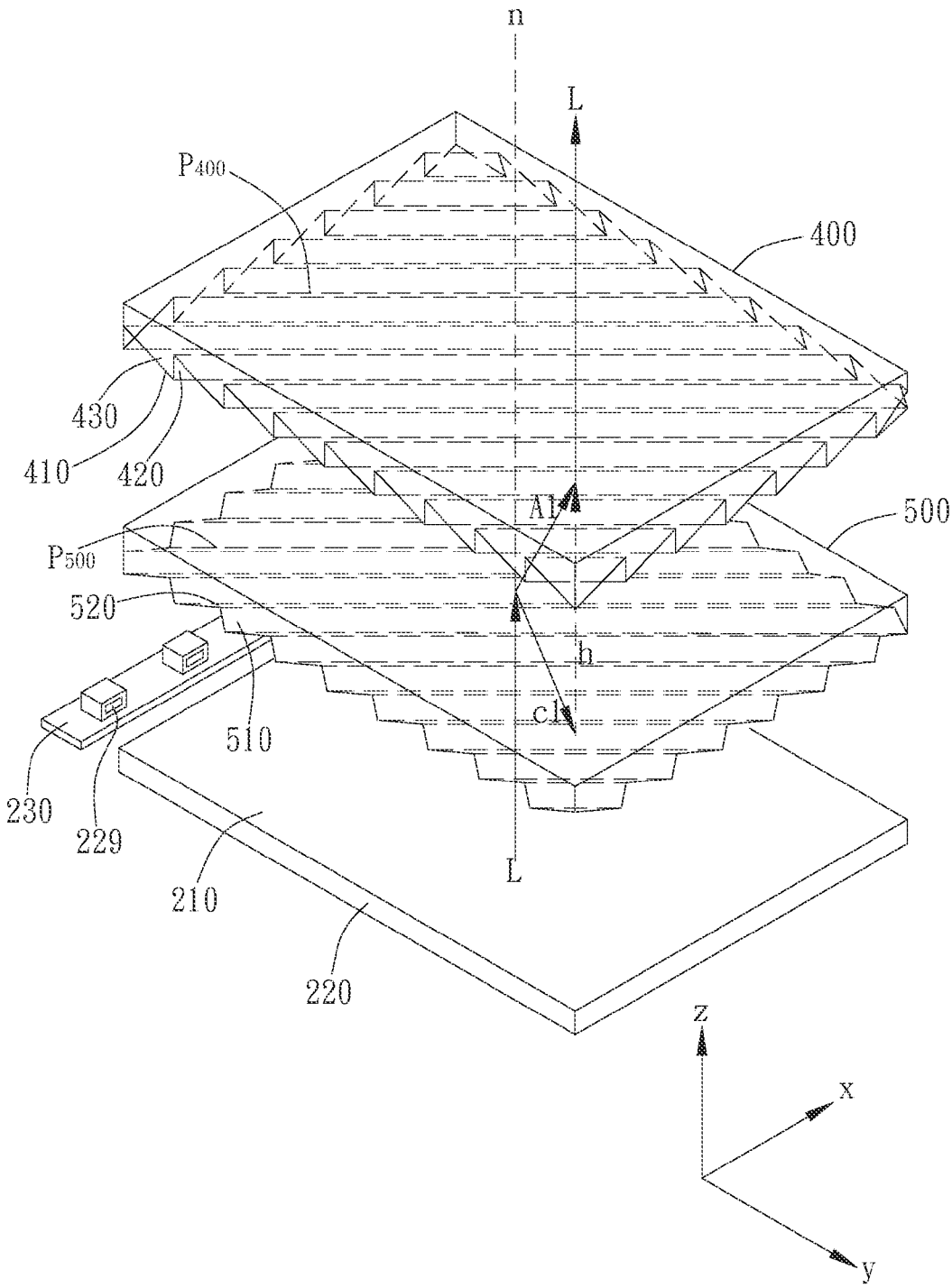
FIG. 8A is an exploded view of another embodiment of the display device.
Figure 8B:
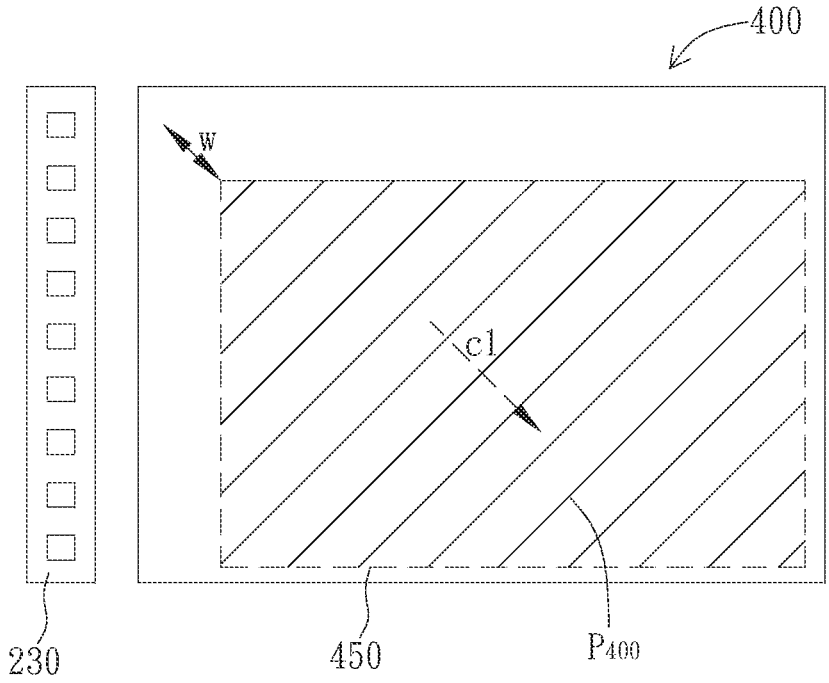
FIG. 8B is a top view of an embodiment of the display device of FIG. 8A.

FIG. 8A is another embodiment of FIG. 7A. As shown in FIG. 8A, the extending direction $P_{500}$ of the light-splitting layer 500 is inclined with respect to the light-entrance side 225 and parallel with the extending direction $P_{400}$. As shown in FIGS. 8A and 8B, the extending direction $P_{400}$ of the prisms 430 of the prism film 400 and the extending direction $P_{500}$ of the light-splitting prisms 530 of the light-splitting layer 500 do not have to be perpendicular to the surface of the light-entrance side 225 of the light source module 230. When the extending direction $P_{400}$ of the prism film 400 is inclined to the light-entrance side 225, the vector component c1 of the first backlight group A1 will be perpendicular to the extending directions $P_{400}$ and $P_{500}$. In this circumstance, the image display area 450 will move in the direction of the vector component c1 (towards the bottom right of the figure) for the distance of image shift distance w such that the border width of the prism area B at the bottom right will decrease.

Figure 9A:
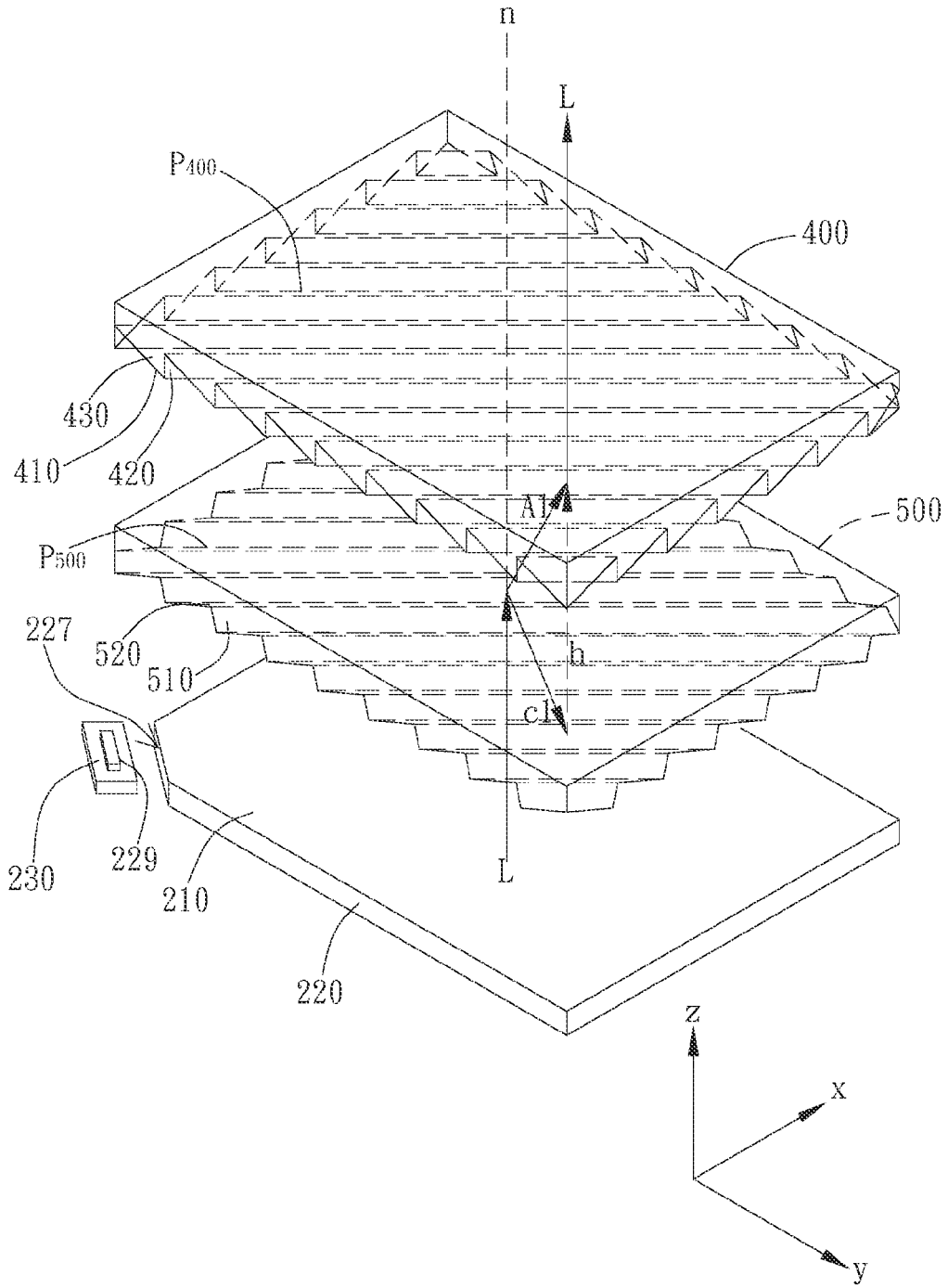
FIG. 9A is an exploded view of another embodiment of FIG. 7A.

However, the disposed position of the light source module 230 is not limited to a side of the light guide plate 220. In other different embodiments, the light source module 230 may also be disposed at a corner of the light guide plate 220, or multiple light source modules 230 may be disposed respectively at two to four corners of the light guide plate 220. FIG. 9A illustrates an embodiment of the light source module 230 being disposed at a corner of the light guide plate 220. For purposes of showing the relationship between the backlight module 200, the prism film 400, and the light-splitting layer 500, the display panel 300 and the grating layer 600 that should be disposed between the light-splitting layer 500 and the prism layer 400 has not been illustrated so that FIG. 9A may be more comprehensible. As shown in FIG. 9A, a corner of the light guide plate 220 is formed as a light-entrance corner 227, wherein the light source module 230 is disposed in front of the light-entrance corner 227. In a preferred embodiment, light-entrance corner is a notched corner having a notched surface to act as a light entrance surface. Simply stated, the embodiment of FIG. 9A is a backlight module utilizing a form of corner light entrance. When light generated from the light source module 230 enters into the light guide plate 220 through the light-entrance corner 227, the light guide plate 220 will emit the light out the light-emitting surface 210 in a direction parallel to the normal line n of the light-emitting surface 210. The projection of the vector component c1 of the average light-emitting direction of the first backlight group A1 onto the light guide plate 220 is perpendicular to the direction of the light-entrance corner 227 to its diagonal corner. In other words, in the present embodiment, the projections of the extending directions $P_{400}$ and $P_{500}$ on the light guide plate 220 are preferably parallel with the diagonal direction of the light-entrance corner 227 to the opposite corner of the light guide plate 220. In the present embodiment, the light source module 230 is disposed at a corner of the light guide plate 220, wherein the direction that the light source module 230 faces the light guide plate 220 is parallel with the extending direction $P_{400}$ of the prisms of the prism film 400. However, when the light source module 230 utilizes the corner light entrance arrangement, the corner that the light source module 230 is disposed at is preferably perpendicular to the extending direction $P_{400}$ in order to cut down the crosstalk interference. In other words, the direction that the backlight generated by the light source module 230 enters the light guide plate 220 is preferably perpendicular to the projection of the extending direction $P_{400}$ on the light-emitting surface 210 so that crosstalk interference may be decreased.

Figure 9B:
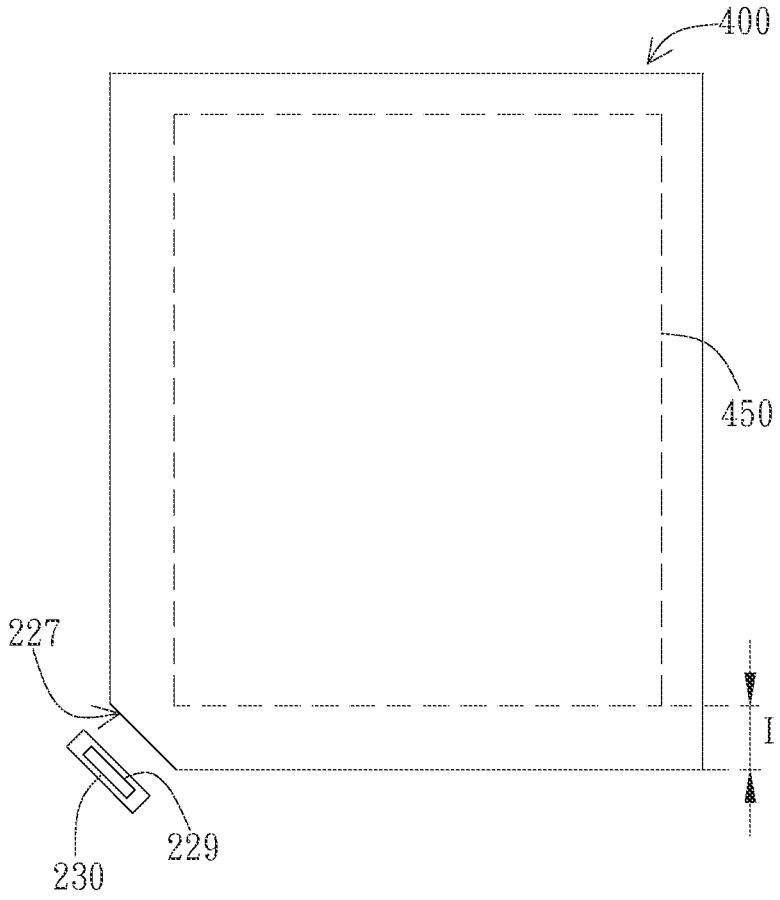
FIGS. 9B and 9C are top views of embodiments of the display device of FIG. 9A.
Figure 9C:
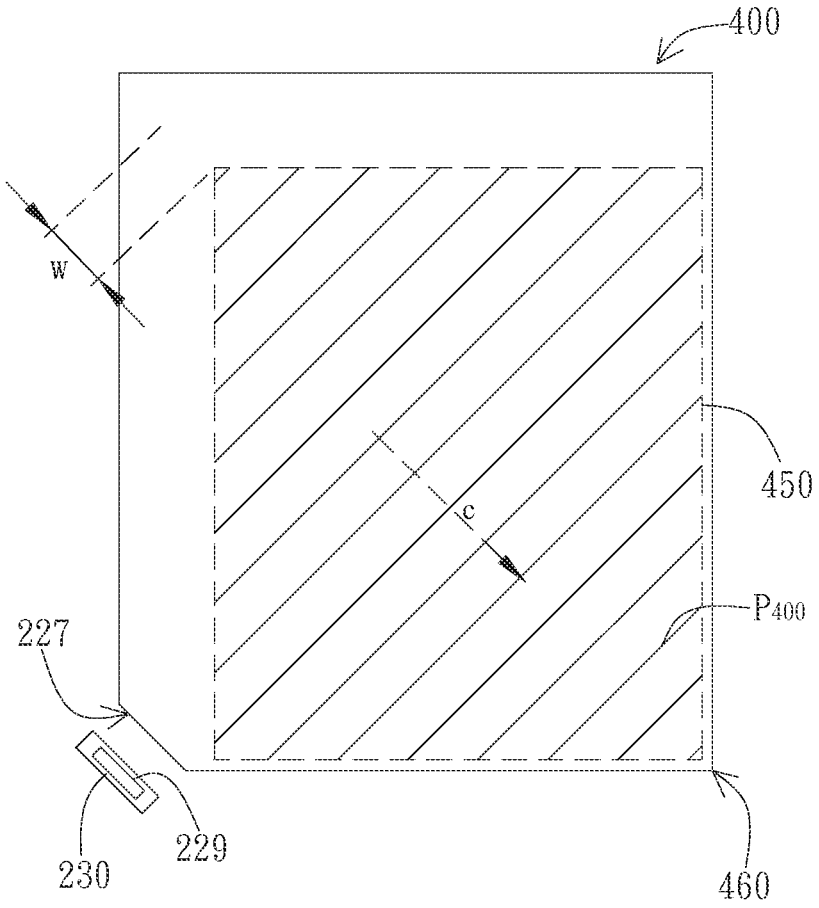

FIG. 9B illustrates a border area of the display device 100. As shown in FIG. 9B, the outer edges of the display surface of the display device 100 has a width of border area B. As shown in FIGS. 9B and 9C, when the projections of the extending directions $P_{400}$ and $P_{500}$ onto the light guide plate 220 is parallel with the diagonal between the light-entrance corner 227 to the opposite corner of the light guide plate 220 (as shown in FIG. 9B), the image display area 450 of FIG. 9C will be moved a distance of image shift distance w towards the corner 460 (i.e. in the direction of the vector component c1) through the refraction/guidance of the light-splitting layer 500 and the prism film 400. In other words, the image display area 450 will shift towards the bottom right, decreasing the image border width on the right and bottom sides.

Figure 10A:
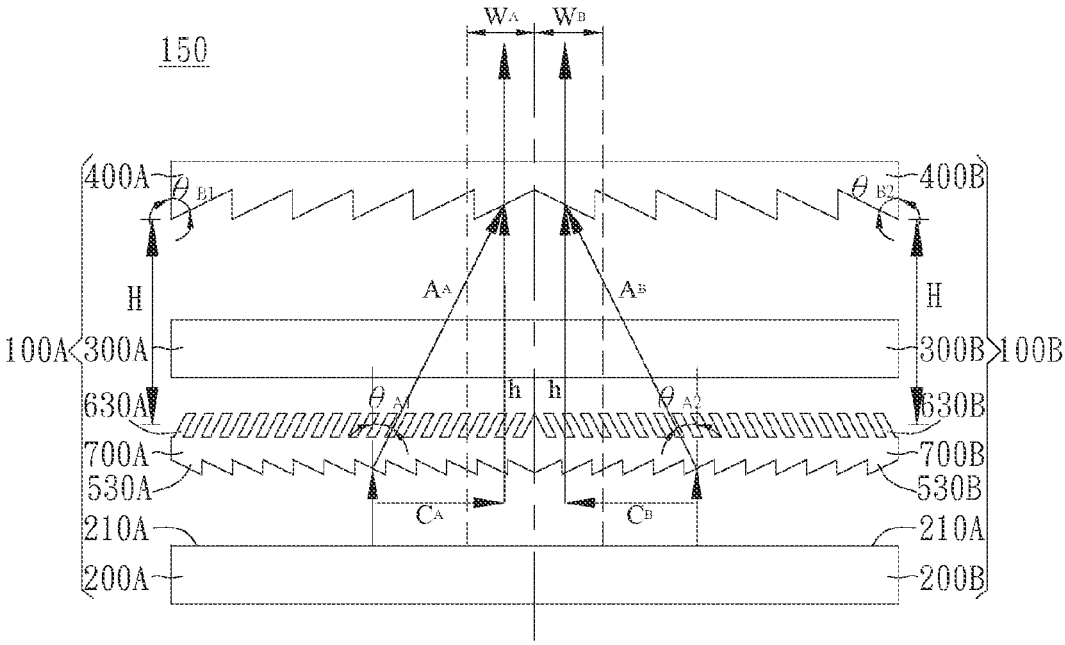
FIG. 10A is a cross-sectional view of an embodiment of the display system.
Figure 10B:
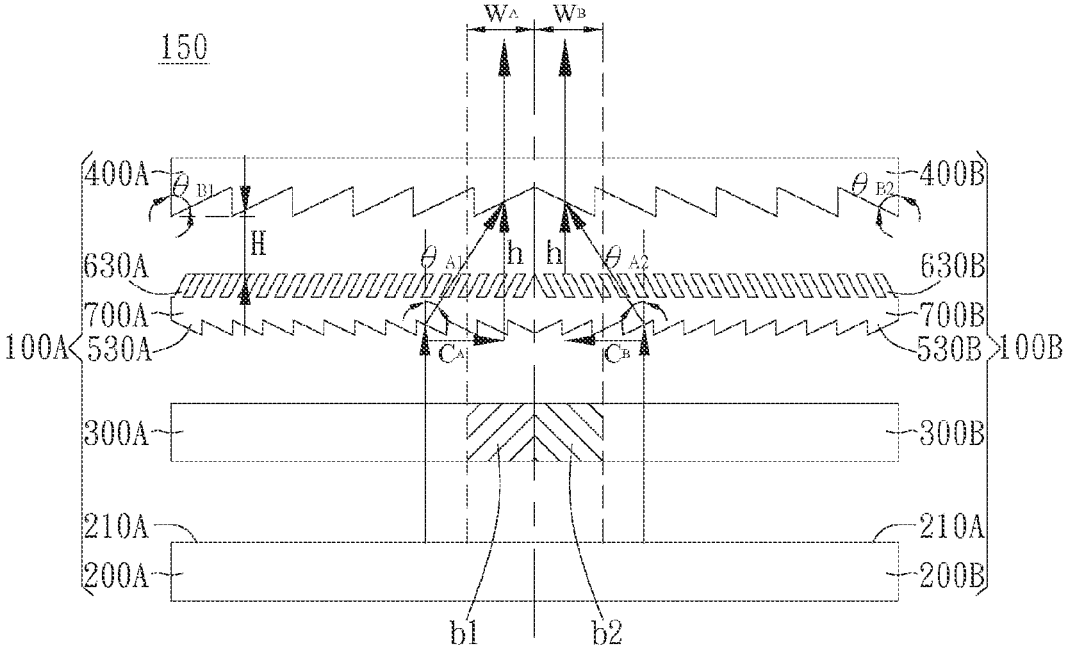
FIG. 10B is a cross-sectional view of another embodiment of FIG. 10A.
Figure 10C:
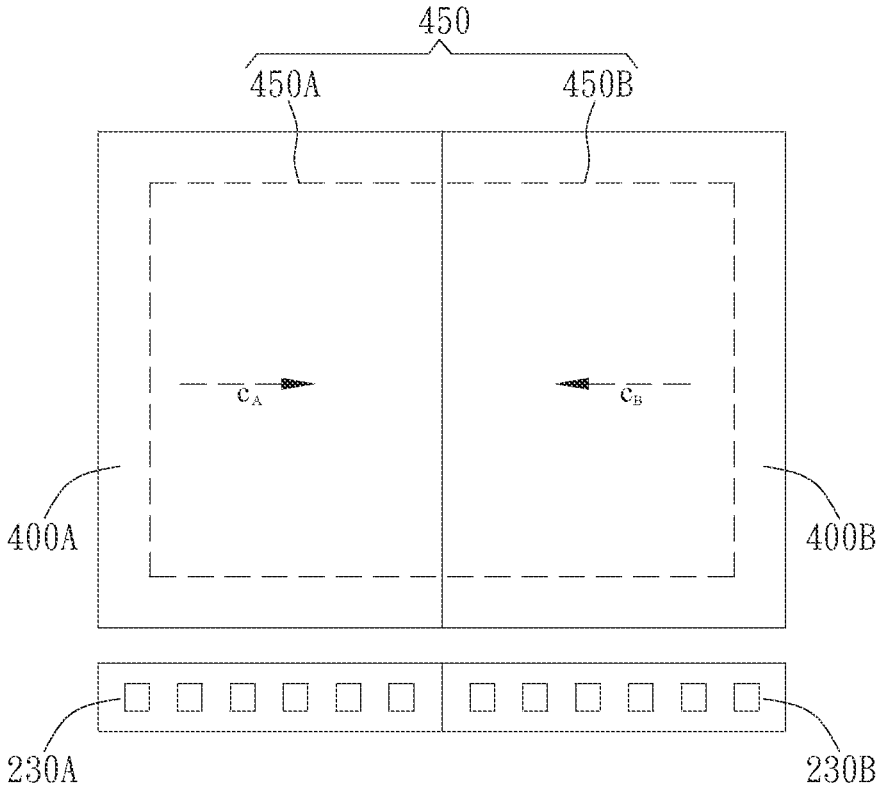
FIG. 10C is a top view of the display system of FIGS. 10A and 10B.

FIG. 10A is an embodiment of the display system 150 of the present invention. As shown in FIGS. 10A and 10B, the display system 150 includes two display devices (display devices 100A and 100B respectively), wherein the display devices 100A and 100B are disposed side-by-side against each other. The vector components (components $C_A$ and $C_B$) of the average light-emitting direction (i.e. direction of the first backlight groups $A_A$ and $A_B$) of each display device on the light-emitting surface are respectively towards each other. In the present embodiment, the light source modules 230 of the backlight module 200A and 200B are preferably arranged side-by-side in a straight line and disposed on a side of the combined display devices 100A and 100B. As shown in FIG. 10A, the display devices 100A and 100B respectively have a display panel border width of prism area $B_A$ and $B_B$. In order to achieve a borderless image effect between the display devices 100A and 100B, the display device 100A will shift its displayed image in the direction of the display device 100B a distance of image shift distance $W_A$ through coordination between the prism film 400A and the optical film 700A (combination of the light-splitting layer 500 and grating layer 600). Conversely, the display device 100B will similarly shift its image that is displayed above the prism film 400B a distance of image shift distance $W_B$ towards the display device 100A. Through this design, as shown in FIGS. 10A and 10C, the image produced in the image display area 450A and 450B of the display devices 100A and 100B will be concentrated towards the center and effectively mask the display panel frame below, ultimately achieving a borderless image effect between the display devices 100A and 100B.

FIG. 10B is another embodiment of FIG. 10A. As shown in FIG. 10B, in order to raise the overall image contrast, the display panel and the prism film may switch places. In the present embodiment, the backlight generated by the backlight module will pass upwards through the display panel (300A/300B) in a direction parallel to the normal direction of the light-emitting surface 210A before arriving at the light-splitting prism (530A/530B) of the optical film (700A/700B) to be refracted towards a direction between the display devices 100A and 100B (direction of the first backlight group A1 or A2). Then, the prism film 400 above will refract the backlight upwards in the direction parallel to the normal direction of the light-emitting surface 210. Through this design, in comparison to the embodiment of FIG. 10A, more backlight may pass through the display panel and then be split by the optical film. As a result, the image contrast will be better. In the present embodiment, as shown in FIG. 10B, height H is the distance between the prism film (400A/400B) and the optical film (700A/700B).

Figure 11:
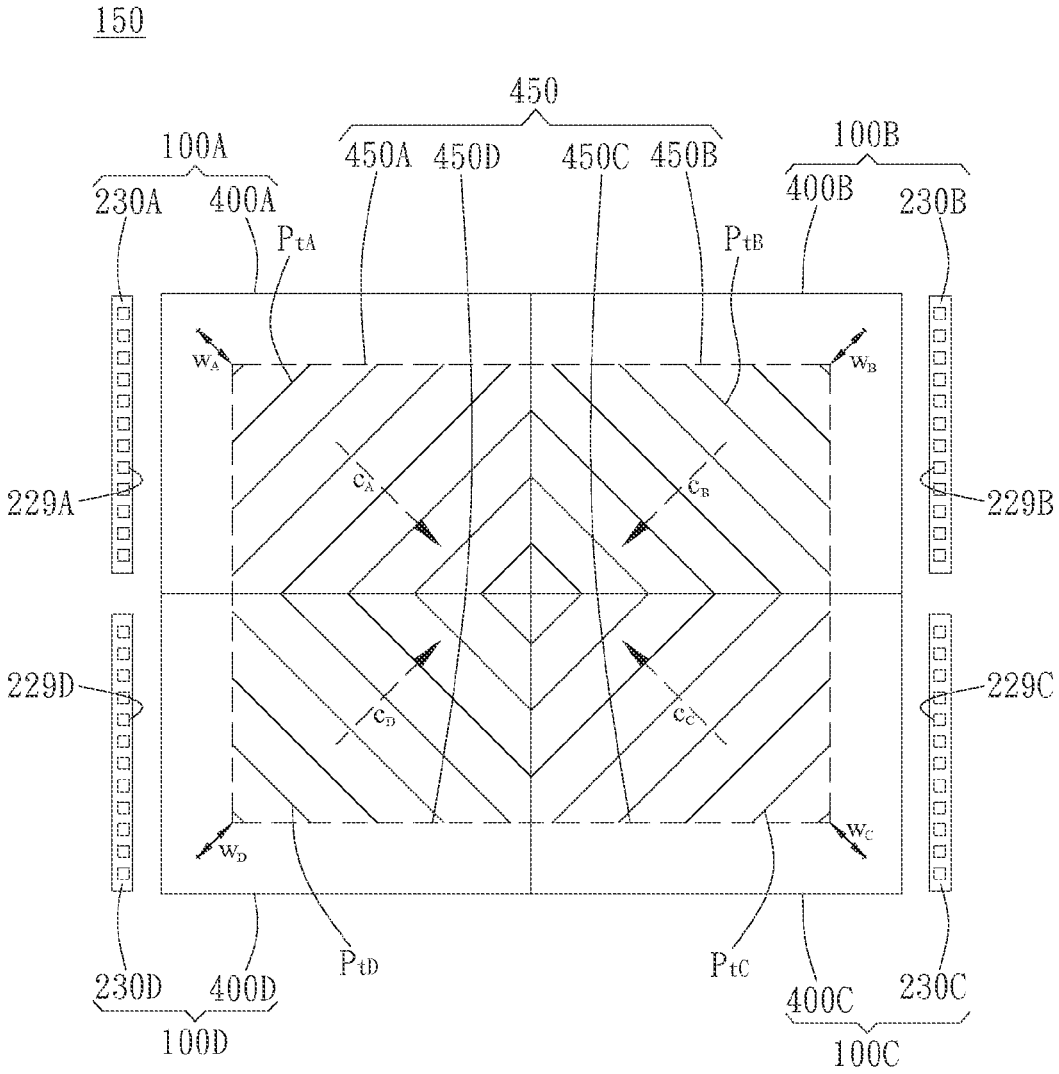
FIG. 11 is a top view of an embodiment of the display system having a 2×2 matrix arrangement.

FIG. 11 is another embodiment of the display system 150. As shown in FIG. 11, the display system 150 may also be formed from four display devices 100 arranged in a 2×2 matrix such that a combined display surface 450 is formed. In the present embodiment, the display system 150 includes display devices 100A, 100B, 100C, and 100D, wherein the light-entrance sides of each display device is positioned at either two opposite sides of the combined display surface 450. In the present embodiment, the prism extending direction $P_{ta}$, $P_{tb}$, $P_{tc}$, and $P_{td}$ collectively surround a center of the display system 150 (i.e. 2×2 matrix), wherein the extending directions of the prisms at diagonal positions are symmetric with respect to the projection of the light-emitting surface. In similar fashion to the embodiment of the display device 100 of FIG. 8B, each of the display devices 100A-100D in the display system 150 will shift their own image display areas towards the center of the display system 150. In terms of the display device 100A as an example, the position of the image display area 450A of the display device 100A will move a distance of image shift distance $W_A$ towards the center of the display system 150 (i.e. in the direction towards display device 100C). In other words, the image displayed by the display device 100A on the image display area 450A will move towards the bottom right such that the display device 100A can achieve a borderless image effect at the bottom right side on the prism film 400A. Conversely, the images produced by each of the display devices 100B, 100C, and 100D will each respectively move towards the center of the display system 150 to collectively combine with the display device 100A form the image display area 450.

Figure 12A:
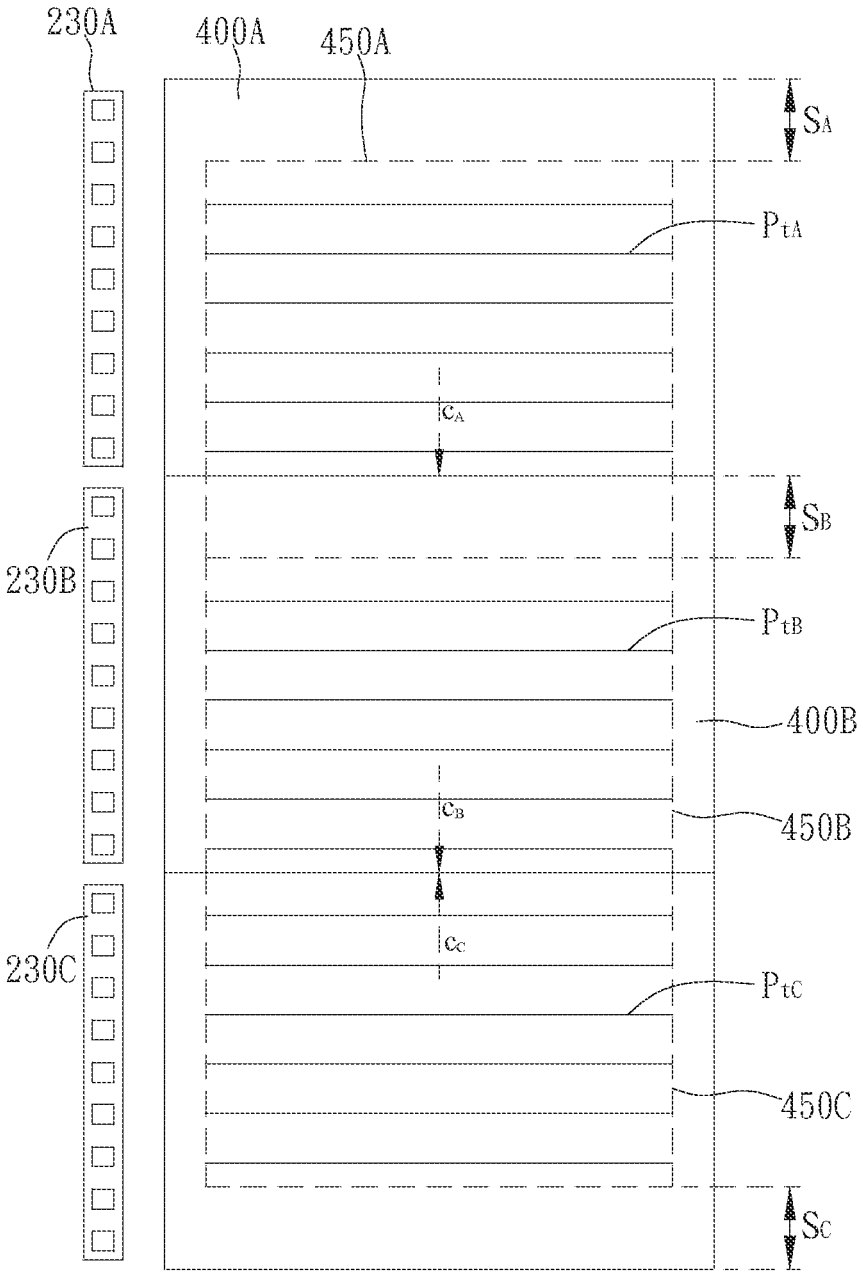
FIG. 12A is top view of an embodiment of the display system having lxM arrangement.

FIG. 12A is an embodiment of a 1×M arrangement, wherein M represents a positive integer number. Specifically, FIG. 12A illustrates an embodiment of a 1×3 arrangement. In the present embodiment, three display devices are stacked together such that their respective light source modules 230A-230C line up in a straight line along a side of the combined display devices. As shown in FIG. 12A, the image display area 450C of the bottom display device is shifted towards the middle display device, while the image display area 450B of the middle display device is shifted towards the bottom display device. In this manner, the image display area 450B and the image display area 450C may form a combined image display area. However, as seen in FIG. 12A, the image display area 450A of the top display device may be shifted towards and overlap into the middle display device. In other words, if the dimensions of all three display devices are identical, and the image display area 450C is shifted towards the middle display device one border width and the image display area 450 B is shifted towards the bottom display device also by one border width, the image display area 450A of the top display device would need to be shifted towards the middle display device by 3 border widths.

Figure 12B:
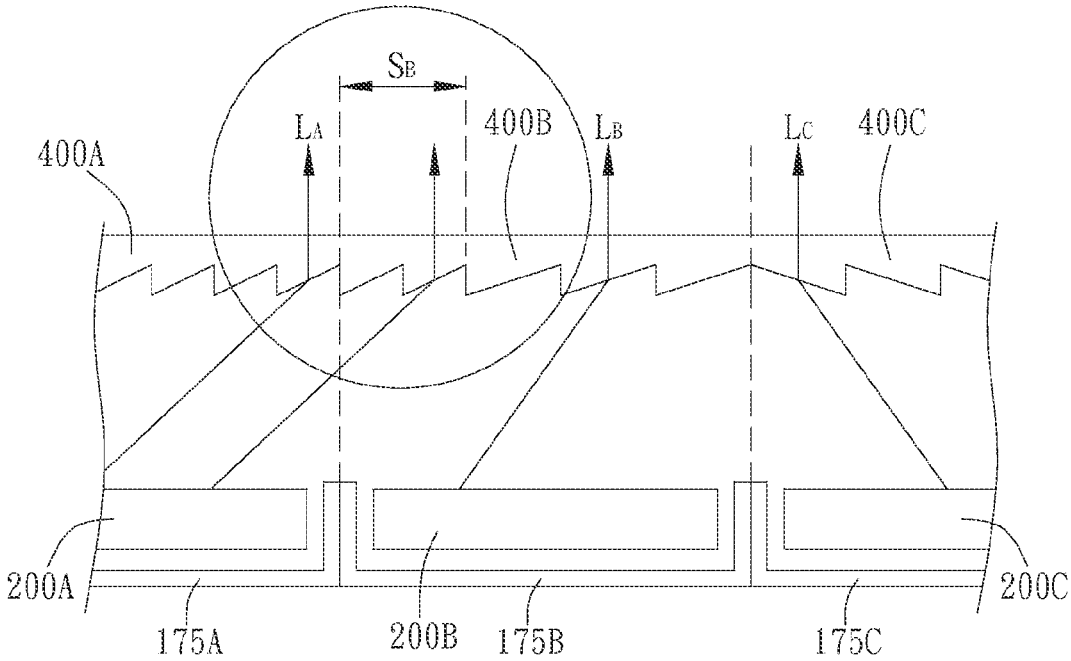
FIG. 12B is a cross-sectional view of FIG. 12A.

FIG. 12B is a cross-sectional view of 12A. It should be noted that the respective display panels of each display device were not illustrated for simplicity's sake. However, it is understood that there are display panels between each layer of prism film and backlight module of each display device. As shown in FIGS. 8A and 8B, light $L_C$ emitting from the backlight module 200C will be inclined towards the middle display device such that its vector component direction $C_c$ is perpendicular to the prism extending direction $P_{tc}$. Light $L_C$ will then be refracted straight upwards by the prism film 400C such that the image display area 450C is shifted towards the middle display device. Similarly, light $L_B$ emitting from the backlight module 200B of the middle display device will be inclined towards the bottom display device. Light $L_B$ will be refracted by the prism film 400B such that the image display area 450B is shifted towards the bottom display device.

However, as seen in FIG. 12B, a portion of the light $L_A$ emitting from the backlight module 200A of the top display device may cross over into the middle display device and are then refracted straight upwards by a portion of the prism film 400B that is not in contact with the light $L_B$. That is, light $L_A$ that is generated by the top display device may reach the portion of the prism film indicated by the border $S_B$ of FIG. 12A such that it may be refracted straight upwards. In this manner, the image display area 450A may be shifted partially crossing over into the middle display device. In the present embodiment, since the image display area 450A needs to be shifted towards the middle display device by 3 border widths while the image display area 450B of the middle display device shifts only 1 border widths towards the bottom display device, the inclination of light emitted from the backlight module 200A will be different from the inclination of light emitted from the backlight module 200B. As such, the prisms of the portion of the prism film 400B will be identical to the prisms of the film 400A so that light $L_A$ from the top display device may be refracted straight upwards by the portion of the prism film 400B in the border width $S_B$. In other words, different portions of the prism film of a particular display device may be designed with different prisms to effectively refract light crossing in from another display device. In this manner, a seamless and borderless combined image display area between multiple display devices may be achieved.

Figure 12C:
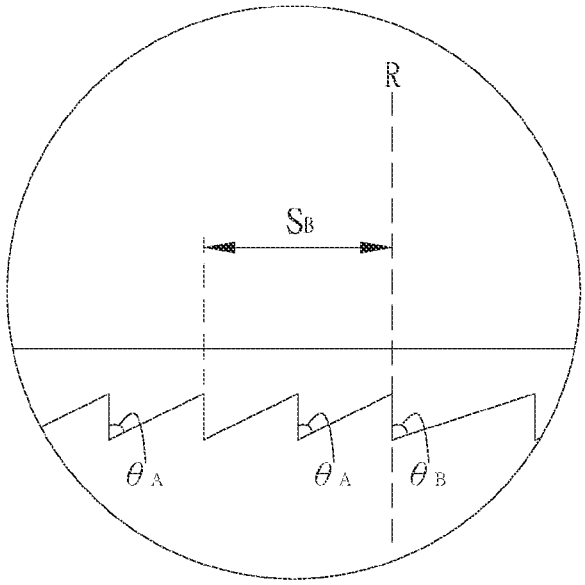
FIGS. 12C and 12D are embodiments of the prisms of FIG. 12B.
Figure 12D:
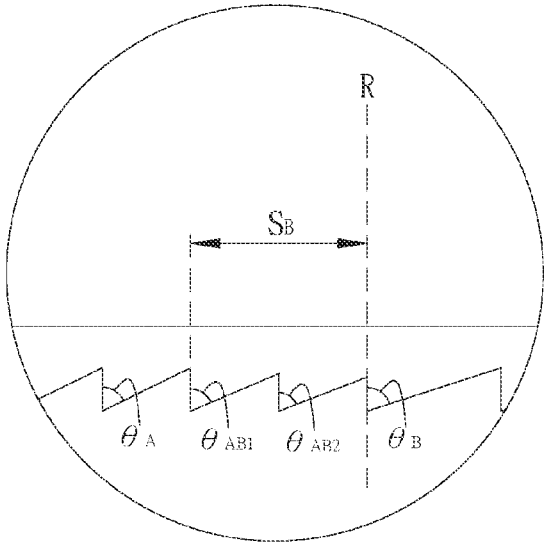

FIGS. 12C and 12D are embodiments of the prisms in FIG. 12B. As seen in FIGS. 12B and 12C, a portion of the prism film 400B has prisms that have the same angle $\theta_A$ as the prisms in the prism layer 400A while the remaining portion of the prism layer 400B has prisms of a different angle $\theta_B$. In this manner, light $L_A$ emitted from the backlight module 200A may be refracted vertically upwards by the prisms having angle $\theta_A$ while light $L_B$ from the backlight module 200B may be refracted vertically upwards by the prisms having angle $\theta_B$. As shown in FIG. 12C, intersection R is the intersection where prisms having angle $\theta_A$ meets prisms having angle $\theta_B$. In other words, in the present embodiment, the prisms lying within the border $S_B$ between prisms having angle $\theta_B$ and the prisms of prism film 400A will all have an angle of $\theta_A$.

However, as seen in an embodiment in FIG. 12D, the prisms situated between the prisms with $\theta_A$ and $\theta_B$ (prisms with $\theta_{AB1}$, $\theta_{AB2}$) may have different angles relative to $\theta_A$ and $\theta_B$. In the present embodiment, $\theta_{AB1}$ and $\theta_{AB2}$ are angles that lie in the range between $\theta_A$ and $\theta_B$, wherein the angles $\theta_{AB1}$ and $\theta_{AB2}$ are angles that are successively increasing from $\theta_A$ to $\theta_B$ or are successively decreasing from $\theta_A$ to $\theta_B$. For instance, if $\theta_A$ is 39 degrees and $\theta_B$ is 45 degrees, $\theta_{AB1}$ may be 41 degrees and $\theta_{AB2}$ may be 43 degrees such that the angles of $\theta_A$, $\theta_{AB1}$, $\theta_{AB2}$, and $\theta_B$ successively increases. In this manner, distinct lines due to the sharp differences in angles of prisms at intersection R would not be formed in the viewable image of the display system.

Figure 13:
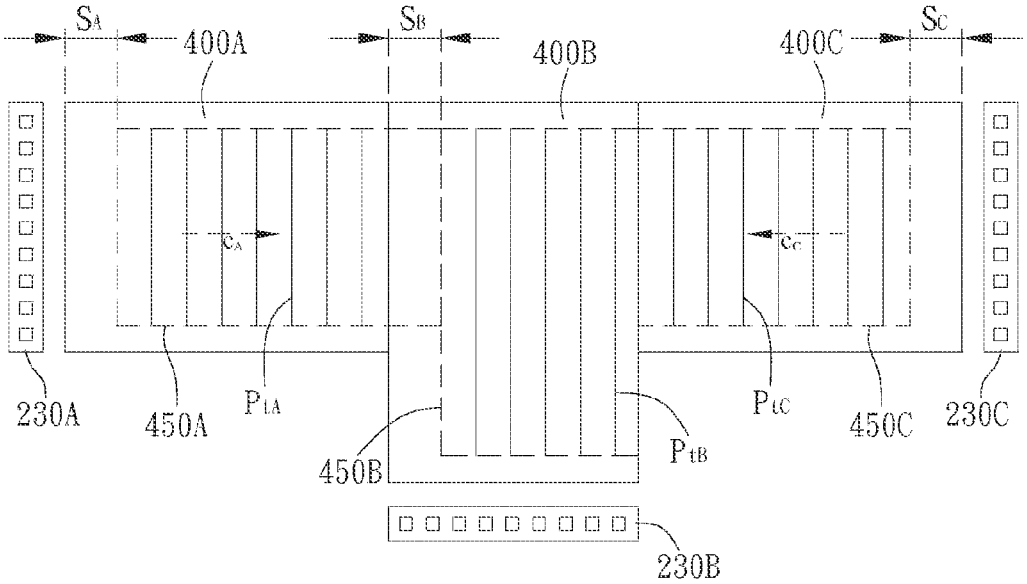
FIG. 13 is a top view of another embodiment of FIG. 12A.

FIG. 13 is another embodiment of FIG. 12A. In the present embodiment, the display device having the image display area 450A is rotated 90 degrees relative to the middle display device, wherein the light source module 230A is disposed on the side opposite the side connecting to the middle display device. Similarly, the display device having the image display area 450C is rotated 90 degrees relative to the middle display device, wherein the light source module 230C is disposed on the side opposite the side connecting to the middle display device. As illustrated in FIG. 13, the image display area 450A is shifted towards the middle display device like the previous embodiment. However, as seen in FIG. 13, the image display area 450B of the middle display device is also shifted in the same direction as the image display area 450B (towards the display device having image display area 450C). Therefore, in order for the display system to have one continuous display area, the image display area 450A would need to be shifted even further in the direction towards the middle display device. That is, the image display area 450B is shifted a length of one border width towards the display device having the image display area 450C, while the image display area 450A is shifted towards the middle display device by a length of 3 border widths such that a portion of the image display area 450A crosses into the middle display device. The underlying techniques for shifting and crossing in are similar to the previous embodiments and will not be further explained.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A display device, comprising:

a backlight module having a light-emitting surface and generating backlight along a normal direction of the light-emitting surface;

an optical film set comprising:

a light-splitting layer disposed above the light-emitting surface, wherein the light-splitting layer splits the backlight into a first backlight group and a second backlight group; average light-emitting directions of both backlight groups are inclined with respect to the light-emitting surface and vector components thereof in a direction parallel to the light-emitting surface have opposite directions; and a grating layer disposed above the light-splitting layer, the grating layer only allowing the first backlight group to pass while blocking the second backlight group from passing;

a display panel disposed above the grating layer; and a prism film disposed on one side of the display panel opposite to the optical film set, wherein the prism film has a plurality of prisms disposed side-by-side on one side of the prism film facing the display panel;

wherein an extending direction of the prisms at least partially traverse across the average light-emitting direction of the first backlight group; two sides of each prism are respectively a first surface and a second surface; the first surface and the second surface are asymmetric and projection areas of the first surface and the second surface onto the prism film do not overlap; an angle between the first surface and a normal line to the light-emitting surface is greater than an angle between the second surface and the normal line to the light-emitting surface; a included angle between the second surface and a parallel line to the light-emitting surface is greater than or equal to 80 degrees and smaller than or equal to 90 degrees.

2. The display device of claim 1, wherein an angle between the first surface and the average light-emitting direction of the first backlight group is smaller than an angle between the second surface and the average light-emitting direction of the second backlight group.

3. The display device of claim 1, wherein the angle between the first surface and the normal line to the light-emitting surface is greater than 40 degrees.

4. The display device of claim 1, wherein the range of the angle between the first surface and the normal line of the light-emitting surface is sufficient to refract the first backlight group so that the average light-emitting direction of the first backlight group is parallel to the normal direction of the light-emitting surface.

5. The display device of claim 1, wherein the first surface faces away from the direction of the vector component on the light-emitting surface of the average light-emitting direction of the first backlight group, and the second surface faces the direction of the vector component on the light-emitting surface of the average light-emitting direction of the second backlight group.

6. The display device of claim 1, wherein the second surface is formed with a light blocking layer to block light.

7. The display device of claim 1, wherein the second surface is perpendicular to the light-emitting surface.

8. The display device of claim 1, wherein the width of each prism is smaller than 100 μm.

9. The display device of claim 8, wherein the width of each prism is smaller than 50 μm.

10. The display device of claim 1, wherein the light-splitting layer and the grating layer are separately formed on independent optical films.

11. The display device of claim 1, wherein the light-splitting layer and the grating layer are formed on opposite surfaces of a single optical film.

12. The display device of claim 1, wherein the light-splitting layer includes a plurality of light-splitting prisms protruding toward the backlight module; the vector components of the first backlight group and the second backlight group on the light-emitting surface are respectively perpendicular to an extending direction of the light-splitting prisms.

13. The display device of claim 12, wherein the backlight module has a light-entrance side; the extending direction of the light-splitting prisms is perpendicular to the light-entrance side.

14. The display device of claim 12, wherein the extending direction of the light-splitting prisms is parallel to a diagonal line of the backlight module.

15. The display device of claim 14, the extending direction of the light-splitting prisms is parallel to the direction of the line connecting the light-entrance side and the opposite angle of the light-entrance side.

16. A display system, comprising: two display devices of claim 1, wherein the two display devices are disposed side-by-side and the vector component on the light-emitting surface of the average light-emitting direction of the first backlight group of each display device is towards the other display device.

17. A display system, comprising: at least four display devices of claim 14, wherein the display devices are disposed in a 2×2 matrix to form a combined display surface, and the direction of the vector component on the light-emitting surface of the average light-emitting direction of the first backlight group of each display device is towards the other display device that is disposed diagonal of the display device.

18. The display system of claim 17, wherein the extending direction of the prisms of the display devices collectively surrounds towards a center of the 2×2 matrix, and the extending direction of the prisms at diagonal positions are symmetric with respect to the projection of the light-emitting surface.

* * * * *